US005383612A

United States Patent [19]

Williams

[11] Patent Number: 5,383,612

[45] Date of Patent: Jan. 24, 1995

[54] APPARATUS FOR SEGREGATING LOW BTU MATERIAL FOR A MULTI-SOURCE OF FUEL MATERIALS

[76] Inventor: Robert M. Williams, 16 La Hacienda, Ladue, Mo. 63124

[21] Appl. No.: 140,568

[22] Filed: Oct. 25, 1993

[51] Int. Cl.[6] ..... B02C 23/30; B02C 23/32; B02C 25/00

[52] U.S. Cl. ..... 241/34; 241/48; 241/52; 241/57; 241/65; 241/79.1

[58] Field of Search ..... 241/33, 34, 48, 52, 241/53, 57, 58, 61, 65, 79, 79.1, 80, 97

[56] References Cited

U.S. PATENT DOCUMENTS

| | | | |
|---|---|---|---|
| 2,354,312 | 2/1944 | Harlow | 241/48 |
| 2,427,903 | 9/1947 | Crites | 241/48 X |
| 3,078,048 | 2/1963 | Russell et al. | 241/48 X |
| 3,950,144 | 4/1976 | Gillette | 241/48 X |
| 4,061,274 | 12/1977 | Williams | 241/48 X |
| 4,226,371 | 10/1980 | Williams | 241/48 X |
| 4,245,570 | 1/1981 | Williams | 241/48 X |
| 4,498,633 | 2/1985 | Williams | 241/48 |
| 4,522,343 | 6/1985 | Williams | 241/58 |
| 4,640,204 | 2/1987 | Williams | 241/34 X |
| 4,750,437 | 6/1988 | Rouse | 110/346 |
| 4,798,342 | 1/1989 | Williams | 241/48 X |
| 4,938,155 | 7/1990 | Williams | 110/345 |
| 4,970,971 | 11/1990 | Williams | 110/346 |
| 4,998,485 | 3/1991 | Williams | 110/234 |
| 5,095,827 | 3/1992 | Williams | 110/234 |

OTHER PUBLICATIONS

Green, Leon Jr., "*They're Off!*" *in the circulating FBC handicap* Nov., 1985, pp. 49–52.

*Primary Examiner*—Timothy V. Eley

*Attorney, Agent, or Firm*—Polster, Lieder, Woodruff & Lucchesi

[57] ABSTRACT

The apparatus for processing a composite supply of material having limestone, culm or gob and pond fines for grinding reduction with coal, has the ability to discard the low BTU value materials and materials hard to grind, and comprising grinding means having a grinding chamber in which the composite supply of material is processed to initiate the first removal of fine material so that the remainder is left to go through a grinding step with emphasis on discarding the low BTU value and hard to grind material while the remainder is subject to reduction to a fineness that responds to a supply of air acting to carry the fines to a cyclone separator to recover the fines for use in a combustion step and reuse the air to circulate through the grinding chamber and pick up heat of combustion to cause moisture reduction in some of the material to improve the efficiency in the grinding process, and to limit the presence of sulfur in the stack gas from the combustion step.

4 Claims, 3 Drawing Sheets

APPARATUS FOR SEGREGATING LOW BTU MATERIAL FOR A MULTI-SOURCE OF FUEL MATERIALS

BACKGROUND OF THE INVENTION

1. Field of the Invention

This invention is directed to apparatus in which a mill for processing a collection of dissimilar materials is employed to effect processing of such material according to the BTU value of the materials, the difficulty of grinding the material, and rendering the combustible material inert to spontaneous combustion.

2. Description of the Prior Art

It is well known in the prior art to employ impact hammer mills and roller mills for processing a variety of materials, some that are essentially similar as to heat value, and some that are different in hardness as well as heat value. In such usage of these mills the general purpose is usually one in which the materials are reduced from a variety of sizes to a product that is of a uniform size to meet subsequent processing and handling. One example of apparatus for the grinding and disposal of gob or culm is disclosed in U.S. Pat. No. 4,998,485 of Mar. 12, 1991. Another example of apparatus is concerned with the use of the heat valve in material for the purpose of drying the material during its grinding reduction, as is disclosed in U.S. Pat. No. 5,095,827 of Mar. 17, 1992.

DESCRIPTION OF THE INVENTION

The apparatus for processing a composite mixture of materials is employed to effect a reduction of the materials to separate out the class of materials which have a low BTU value and a hardness that is difficult to reduce by grinding so as not to encumber combustion equipment.

A preferred material grinding apparatus is rendered capable of operating to discard a class of materials of low BTU value on the basis of the hardness characteristic of such material.

The general object of the invention is to process an assortment of material for disposal by combustion, thereby to supply a source of useful heat energy, and to discard some materials that are low in BTU values and possess undesirable hardness so that the remainder of the material assortment can be subjected to combustion.

A more specific object of the invention is to employ a grinding mill with provision for discarding a class of materials known to be low in BTU values or hard to grind, and subjecting the discarded material to a step of analysis of at least the BTU value so as to limit the quantity of material to be discarded.

Another object of the invention is to provide apparatus capable of processing such materials as limestone, coal, gob, culm and like materials in a combined flow through a grinding step and discarding the low BTU value components while processing the remainder of such materials as fuel for combustion to produce hot moisture reduction gas returnable to the mill.

The apparatus for processing a composite supply of material having limestone, culm or gob and pond fines for grinding reduction with coal, has the ability to discard the low BTU value materials and materials hard to grind, and comprising grinding means having a grinding chamber in which the composite supply of material is processed to initiate the first removal of fine material so that the remainder is left to go through a grinding step with emphasis on discarding the low BTU value and hard to grind material while the remainder is subject to reduction to a fineness that responds to a supply of air acting to carry the fines to a cyclone separator to recover the fines for use in a combustion step and reuse the air to circulate through the grinding chamber and pick up heat of combustion to cause moisture reduction in some of the material to improve the efficiency in the grinding process, and to limit the presence of sulfur in the stack gas from the combustion step.

BRIEF DESCRIPTION OF THE DRAWING

The apparatus for practicing the invention is illustrated in a sequence of drawings of components making up preferred embodiments which include.

DETAIL DESCRIPTION OF THE EMBODIMENT

Figure 1:
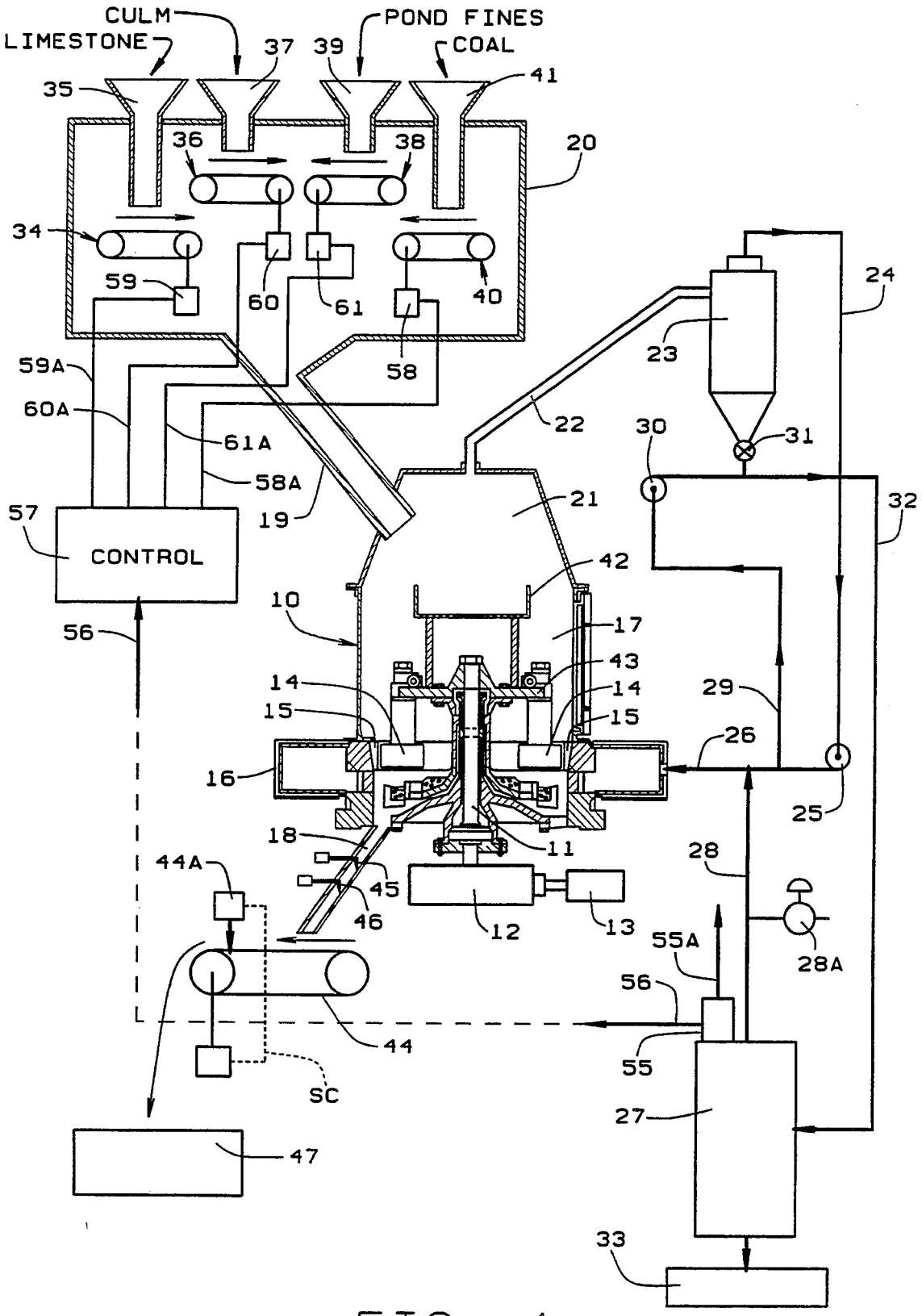
FIG. 1 is a schematic system of apparatus for processing a plurality of materials according to the invention.

The apparatus in FIG. 1 comprises a roller mill 10 of well known construction seen in U.S. Pat. No. 4,522,343 of 1985. A central shaft 11 operatively connected through a suitable gear assembly 12 and motor 13 for the grinding rollers 14 to grind material against the bull ring 15. The usual air supply bustle 16 surrounds the grinding chamber 17 to supply carrier air for the ground material. The bottom of the chamber 17 is provided with an outlet conduit 18 for the escape of components of material that are low in BTU value as well as being hard and difficult to reduce. The roller mill 10 is provided with a material inlet 19 to receive the material from an air tight compartment 20. A ground material dispersing chamber 21 is incorporated in the mill chamber 17 so that the ground material can be separated into large particles for regrinding, and fine particles to be removed through an outlet conduit 22 to a cyclone separator 23 of well known construction which collects the ground material and releases the carrier air through conduit 24 to the inlet side of a fan 25. The fan 25 has its outlet conduit 26 connected into the bustle 16 at the mill 10.

It is shown in the schematic drawing of FIG. 1 that for processing material having a moisture content that would be expected to plug a mill or at least make grinding difficult, the returning air by conduit 26 is supplied with hot gas from a suitable circulating fluid bed furnace or fluidized boiler 27 connected by conduit 28 to the conduit 26 so the mill 10 operates under a drying inlet atmosphere of the order of about 500° F. When tempering outside air is needed to change the temperature of the hot gases, a tempering air valve 28A is provided. While the cyclone separator 23 may release fine particles in the air flow in conduit 24, there is provided a branch conduit 29 leading to a fan 30 for returning a portion of the output gas from the cyclone 23 for partially cleaning the air in conduit 26 of solids before delivering the air to the mill bustle 16. The thus collected solid particles can be combined with the particulate product of the cyclone 23 introduced at the outlet valve 31 into conduit 32 fed into the circulating fluidized boiler means 27 which operates at a temperature level of the order of 1500° F. The ash resulting from combustion is removed from the combustion means 27 and collected in collection means 33.

In the foregoing embodiment the material is supplied to the feed conduit 19 from sources represented by a system of conveyors operatively mounted in the air tight compartment 20. That compartment houses a conveyor 34 positioned to receive the supply of limestone from feed bin 35. Next, a conveyor 36 is positioned to receive a supply of culm from the bin 37, and next is a conveyor 38 positioned to receive pond fines from bin 39. A further conveyor 40 receives a supply of coal from bin 41. These several materials are comingled in the compartment in any desired volume and move into the feed conduit 19 which enters chamber 21 and upon operation of the mill rollers, a spinner table 42 connected to the beam 43 supporting the rollers 14 throws the material outwardly so the large particles can fall into the rollers for reduction and the fine particles can be conveyed by the carrier air from the bustle in conduit 22 for separation as before noted. For example, a presized limestone conveyor 34, a pond fines conveyor 38, a coal conveyor 40, and a conveyor 36 for supplying gob and/or culm can all be arranged to deliver that assortment of material into the feed conduit 19. It is contemplated that from the assortment of material that which has a low heat value in the area of about 2000 BTU per pound will be released at the outlet conduit 18. Also, gob and/or culm are typically wet materials which require a hot gas drying condition to prevent plugging the grinding mill 10. Of the materials subject to reduction, the GOB will contain shale/rock which has a low BTU value and is the hardest material to reduce which will make this prime material to be released from the mill 10 at the conduit 18. A conveyor 44 at the outlet 18 collects the hard to grind material and moves it through a Gamma-metrics or other suitable BTU analyzer 44A which detects the BTU value having the range of up to about 2000 BTU per pound. The analyzer 44A is also employed to regulate the rate of removal of the material moved by conveyor 44 by a suitable circuit SC shown in broken outline which is set to sense the BTU content of material carried by the conveyor. The analyzer 44A reads the BTU response of the material and when material having a higher BTU response is introduced the motor 44 slows the conveyor so as to minimize the BTU material being released from the mill. As a result the material in the bustle will accummulate and be ground leaving the hard portion to be expelled into the outlet 18. Ambient air is prevented from entering the mill 10 through the outlet conduit 18 by the action of flap valves 45 and 46 which are weighted to close the valve but yield to the hard to grind material that is desired to be expelled from the mill 10, as explained above. The conveyor 42 delivers the material to a receiver 47.

The foregoing described embodiment of apparatus operates to extract low BTU and hard to grind materials from other fuel which makes up a source of fuel for feeding a circulating fluidized boiler. The character of the fuel being considered includes coal, pond fines, gob or culm and presized limestone. The coal may be of a relatively low moisture character, while gob or culm can be a class of fuel having a high order of moisture content in the range of about 15%. The pond fine material is another relatively high moisture content material of approximately 12% to 20%. The object of this apparatus is to dispose of waste material that is sticky and wet but which must be reduced by grinding to a uniform particulate size so as to condition the material for sustaining combustion to realize a source of heat from the BTU content of such materials. The heat content developed by the circulating fluidized boiler 27 can be applied to aid in moisture reduction at the grinding mill. A start-up outside source of heat (not shown) can be brought in to start up the system, as well as to keep the heat supply to the grinding mill at a desired level.

The hot gaseous fluid, ground material and hot vapors that are emitted from the grinding mill 10 are conducted through a cyclone separator 23 which removes a high proportion of uniform size particulate material. The material is released at rotary valve 31 into the suitable conduit 32 where it can be moved by the blower 30 to the boiler means 27 for disposal by combustion. The residue of combustion is ash that can be collected at the ash receiver 33.

The schematic view in the drawing of FIG. 1 depicts a first material moving circuit which is associated with the sources of materials 35, 37, 39 and 41, and includes the grinding mill 10, and the mill has an outlet means to discharge hard to grind material under controlled conditions regulated by a BTU analyzer 44A. There is a second circuit 21, 22, 23, 24 25 and 26 which handles the hot gaseous fluid from the cyclone 23 so that can be recirculated in conduit 24 to the grinding mill 10 for material drying purposes.

The present apparatus has undertaken to dispose of materials identified in FIG. 1 under conditions that can be monitored by analyzer 55 for the presence of sulfur in the gases issuing at stack 55A from the circulating fluid boiler or combustor 27. To accomplish this aspect, the combustor 27 is provided with the before identified well-known stack gas analyzer 55 in stack 55A which responds to the sulfur content of the stack gas. That analyzer 55 has a lead 56 which is connected into a control system in the housing 57 for the purpose of being able to make necessary adjustments in the rate of feed of the various sources of material to be processed in the system. For example the primary control is to adjust the rate of supply of coal from conveyor 40 by regulating the conveyor drive motor 58. The content of sulfur in the coal can be modified in the stack gas by adjusting the rate of supply of limestone by its conveyor motor 59. Motor 58 is controlled by signal from lead 58A at the control 57. Similarly, the motor 59 for the limestone conveyor 34 is subject to control from a signal through lead 59A from the control 57. In a similar manner the motor 60 for the feed of culm or gob is adjusted by a signal from control lead 60A at the control 57. Likewise, motor 61 for the feed of pond fines is adjusted by a signal from the control 57 at lead 61A. It is to be understood that the rate of supply of culm or gob and pond fines is dependent on the BTU energy in the gas in the stack 55A which is added to the BTU energy in the coal, and the content of the sulfur detected by the analyzer 55 in the stack 55A is adjusted by increasing or decreasing the rate of feed of the limestone by conveyor 34.

Figure 2:
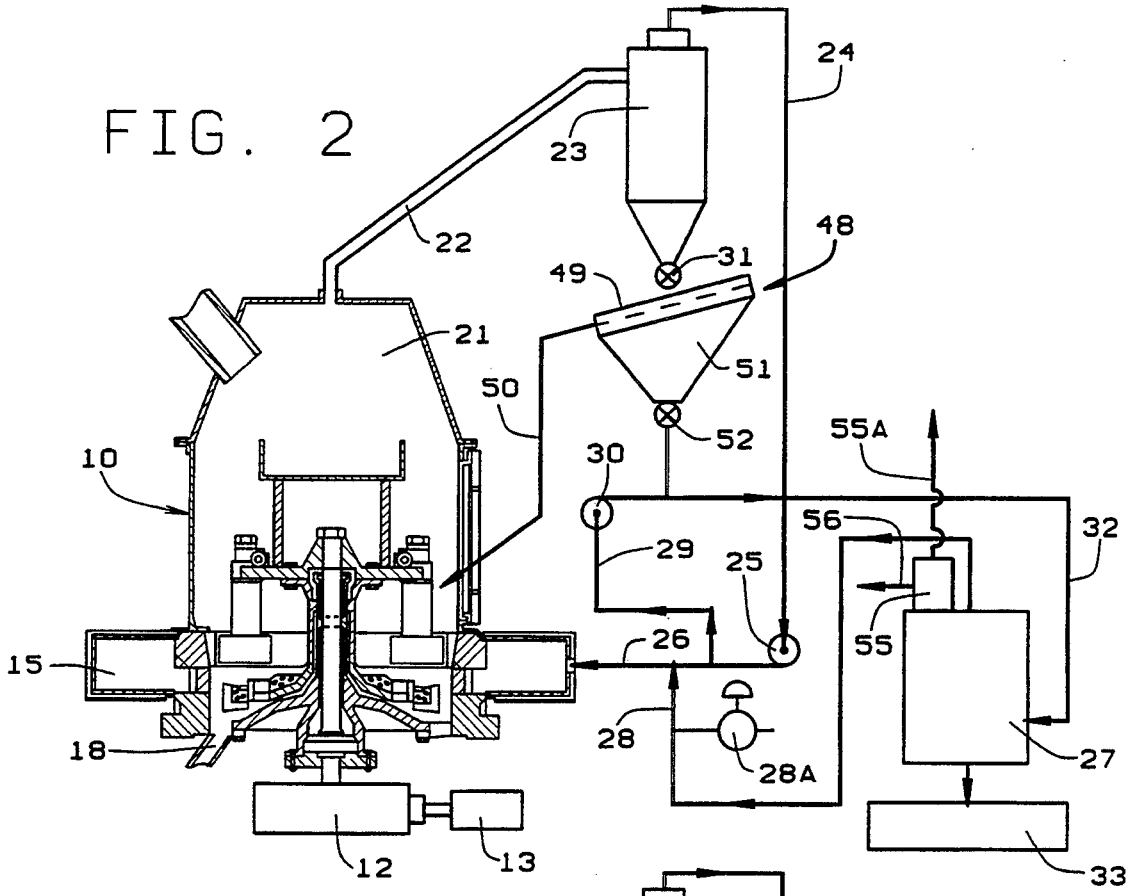
FIG. 2 is a schematic variation of part of the system of FIG. 1.

The embodiment described in the schematic view of FIG. 1 may be modified as shown in the schematic view of FIG. 2 where the same components identified in FIG. 1 are repeated to the extent deemed necessary for an understanding of the modification. With this introduction for FIG. 2, it can be seen that the product matter released at the cyclone rotary valve 31 is received in a vibratory screen device 48 which separates the burnable fine material from the larger material. Thus, the larger material is directed out of the screen 49 into conduit 50 for return to the mill 10 at the zone just above the grinding rolls 14. (See FIG. 1.) The fine material drops out of the screen 49 into a collector 51 for release through the rotary valve 52 to the conduit 32 where it is moved by blower 30 into the combustor 27.

Figure 3:
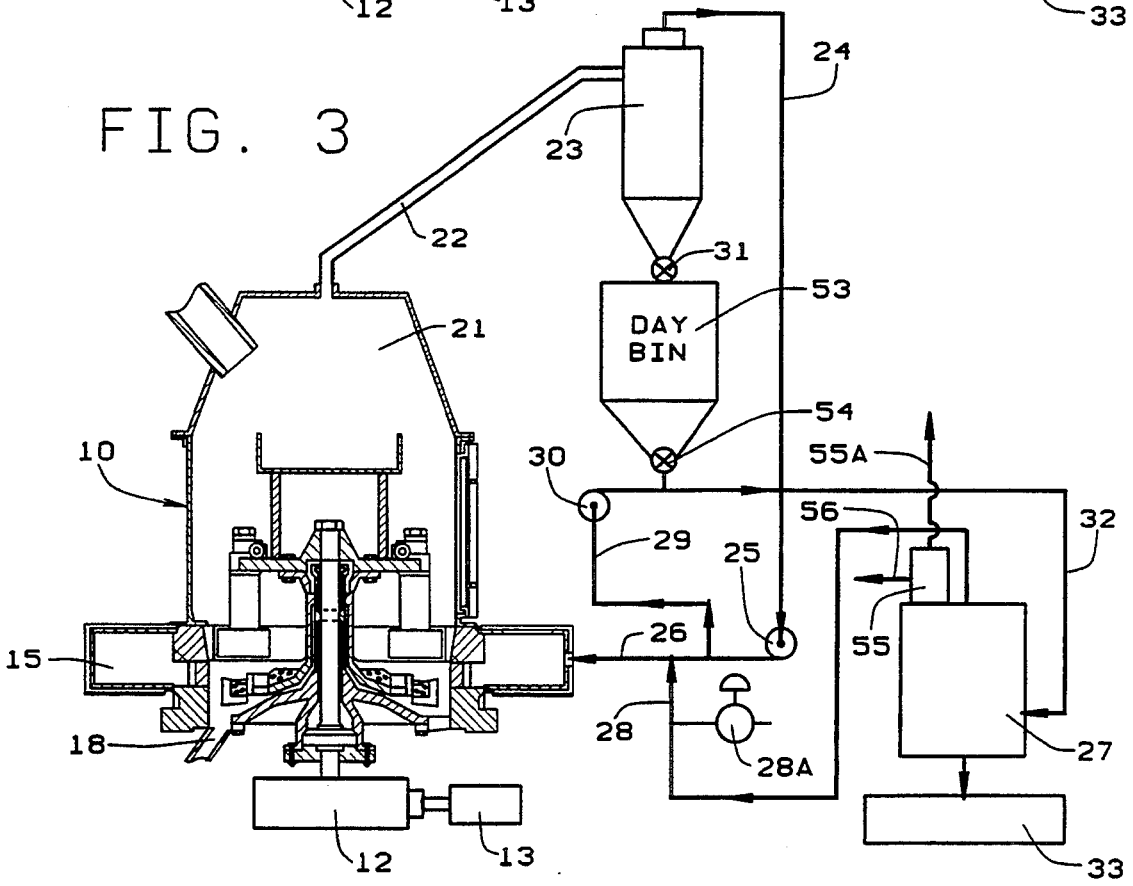
FIG. 3 is a further partial schematic variation of the foregoing embodiments of the invention.

A further embodiment for modifying the schematic view of FIG. 1 is seen in the view of FIG. 3. It is to be understood that the components in FIG. 3 which duplicate those described and shown in FIG. 1 function in a similar manner. The difference shown in FIG. 3 resides in the inclusion of a day bin 53 which holds in storage the fine material released through rotary valve 31 from cyclone separator 23. The purpose of the day bin 53 is to accumulate a supply of fine material in the event some part of the system requires service without shutting down the entire system. When the ground material is collected in the day bin, the limestone coats the coal particles and suppresses any tendency to develop spontaneous combustion which renders the system safe. Furthermore, the use of limestone in the fashion described allows the use of more volatile coal without increasing the danger of spontaneous combustion, and the quantity of coal can be increased as needed. The contents of the day bin 53 is released through rotary valve 54 into conduit 32 where it is blown or moved into the combuster 27 to produce heat for drying the material in the mill 10 to prevent plugging by the wet material from the source 20.

Figure 4:
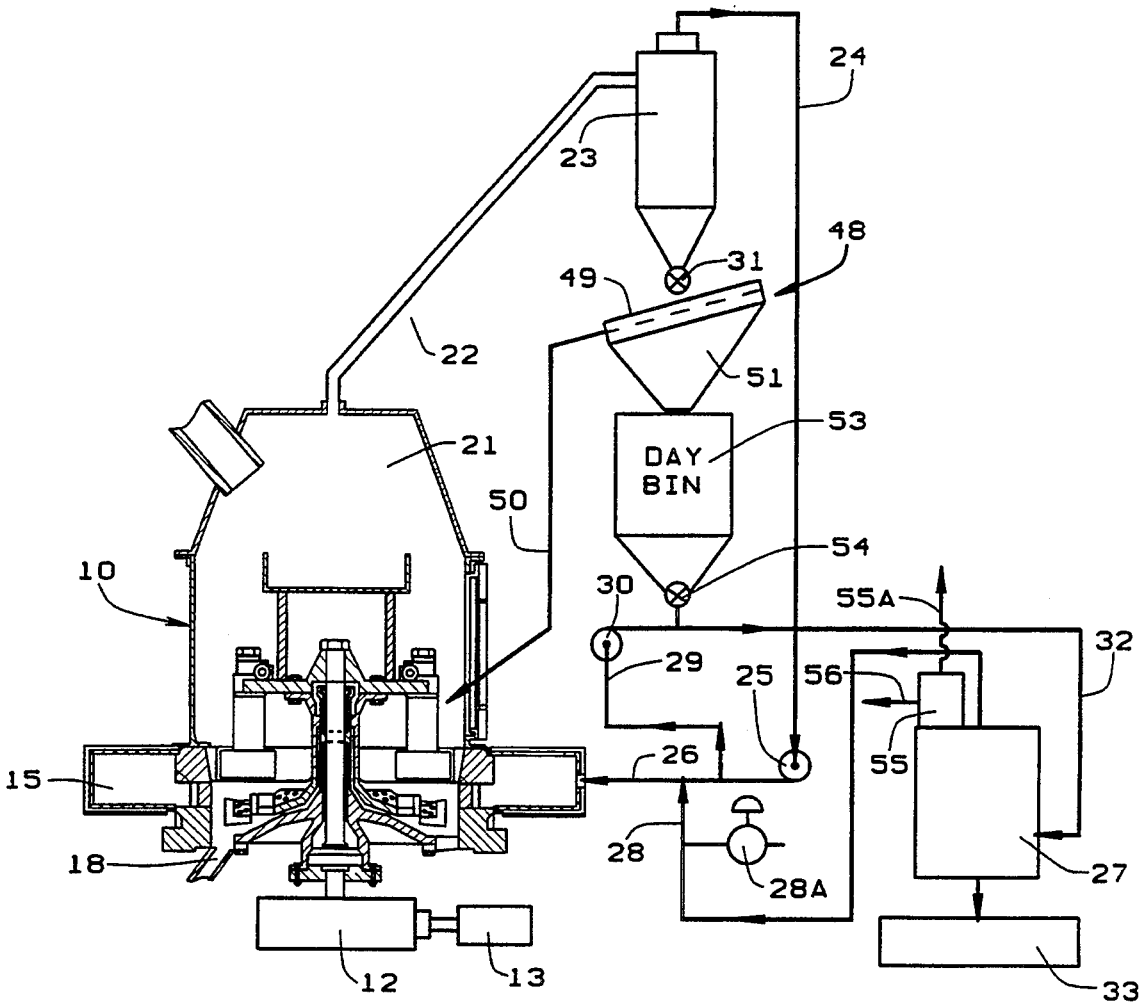
FIG. 4 is yet another partial schematic variation of the embodiments of the invention.

In the view of FIG. 4, there is shown schematically a further modification of the apparatus described in FIG. 1. The disclosure of the various components seen in FIG. 1 continues in FIG. 4 to function as originally described. The modification in FIG. 4 is intended to combine in the system the functioning of the vibratory screen 48 of FIG. 2 and the concept of the day bin 53 of FIG. 3. Thus the versatility of the system of FIG. 4 is enlarged by the combination of the vibratory screen 48 and the day bin 53 components.

The foregoing description has identified suitable modification of a principal system set forth in FIG. 1 for processing several different sources of material for simultaneous grinding to a desired size for obtaining a desired source of fuel for a circulating fluid combustor. The heat energy obtained from the material makes it possible to process waste material which is normally in a wet state that could plug a mill, but does not do so when processed as described herein. The several systems disclosed herein embody a unique way to dispose of material that can be applied to obtain heat energy, and further modifications may come to mind to satisfy the principles of the invention.

What is claimed is:

1. Apparatus for processing low BTU fuel material to segregate the material rendered hard to grind and having minimum BTU content; said apparatus comprising:

a) a material grinding mill having a material inlet, a first material moving circuit containing a source of fuel material connected into said material inlet, a first discharge from said grinding mill for hard to grind material with low BTU content, and a second material discharge from said grinding mill; and b) a second material moving circuit having a first connection with said second material grinding mill discharge and an air moving fan having a connection with said material grinding mill for supply of gaseous fluid, a source of material combustion means to supply drying heat connected into said second material moving circuit for supplying the drying heat to said grinding mill to effect material moisture drying conditions in said grinding mill.

2. Apparatus for processing materials from a source of materials having characteristics collectively of low BTU content, hardness to grinding and wetness and separating the low BTU and hardness materials from the other materials, the apparatus comprising:

a) a chamber enclosing a source of material to be processed;

b) means for actuating the delivery of said separate supplies;

c) control means operatively connected to said actuating means for varying the delivery of said separate supplies;

d) a material grinding mill having a grinding chamber with a first inlet for receiving material from said chamber enclosing source of material, a first outlet from said mill for material having a fineness characteristic responsive to carrier air, and a second outlet for discarding low BTU and hardness material from the grinding chamber;

e) a second inlet to said grinding mill to introduce carrier air for moving the material having a fineness characteristic out of said grinding chamber through said first outlet;

f) cyclone means having a material inlet connection to said first outlet from said mill for receiving fineness material and carrier air, a second connection to said mill first inlet for supplying the carrier air go said mill substantially free of fineness material, and an outlet for fineness material separated from said carrier air;

g) combustion means for producing hot gas for supply to said mill for reducing the wetness of the material in said grinding mill, said combustion means being connected to said cyclone means to receive the fineness material as combustion fuel and having a connection to said second mill inlet; and h) means connected to said second mill outlet to receive material having low BTU and hardness characteristics to be discarded from said grinding chamber.

3. The apparatus set forth in claim 1 wherein said combustion means includes means sensitive to the hot combustion gas produced therefrom for assessing the presence of sulfur, said sensitive means being connected to said control means for effectively varying the supplies of material to limit the sulfur to a range in the order of 5%.

4. The apparatus set forth in claim 1 wherein said separate supplies of material include limestone and coal, said combustion means includes means sensitive to hot combustion gas for assessing the presence of sulfur, and means connecting the sensitive means with said control means to vary said supply of limestone for maintaining the range of sulfur detected in the hot combustion gas to a range of the order of 5%.

* * * * *